US008215397B2

(12) United States Patent
Griffith

(10) Patent No.: US 8,215,397 B2
(45) Date of Patent: Jul. 10, 2012

(54) SYSTEM AND METHOD OF DYNAMIC UNDERBALANCED PERFORATING USING AN ISOLATION FLUID

(75) Inventor: Martin Griffith, Trincity (TT)

(73) Assignee: Schlumberger Technology Corporation, Sugar Land, TX (US)

( * ) Notice: Subject to any disclaimer, the term of this patent is extended or adjusted under 35 U.S.C. 154(b) by 276 days.

(21) Appl. No.: 12/650,350

(22) Filed: Dec. 30, 2009

(65) Prior Publication Data

US 2011/0155375 A1 Jun. 30, 2011

(51) Int. Cl.
*E21B 43/119* (2006.01)

(52) U.S. Cl. ..... 166/297; 166/55.2

(58) Field of Classification Search ..... 166/297, 166/298, 55.2
See application file for complete search history.

(56) References Cited

U.S. PATENT DOCUMENTS

| | | | | |
|---|---|---|---|---|
| 2,693,856 | A * | 11/1954 | Allen | 166/286 |
| 4,439,333 | A * | 3/1984 | House et al. | 507/216 |
| 4,663,366 | A * | 5/1987 | Drake et al. | 523/130 |
| 4,799,550 | A | 1/1989 | Harris et al. | |
| 5,443,123 | A * | 8/1995 | Wall et al. | 166/288 |
| 5,614,475 | A | 3/1997 | Moorhouse et al. | |
| 5,697,444 | A | 12/1997 | Moorhouse et al. | |
| 5,697,555 | A | 12/1997 | Robinson | |
| 5,950,729 | A | 9/1999 | Dawson et al. | |
| 5,972,850 | A | 10/1999 | Nimerick | |
| 6,598,682 | B2 | 7/2003 | Johnson et al. | |
| 6,732,798 | B2 | 5/2004 | Johnson et al. | |
| 6,737,386 | B1 | 5/2004 | Moorhouse et al. | |
| 6,874,579 | B2 | 4/2005 | Johnson et al. | |
| 6,966,377 | B2 | 11/2005 | Johnson et al. | |
| 7,036,594 | B2 | 5/2006 | Walton et al. | |
| 7,238,648 | B2 | 7/2007 | Dahayanake et al. | |
| 7,345,013 | B2 | 3/2008 | Fraser et al. | |
| 7,451,819 | B2 | 11/2008 | Chang et al. | |
| 2004/0089449 | A1 | 5/2004 | Walton et al. | |
| 2005/0217853 | A1 * | 10/2005 | Hayes et al. | 166/297 |
| 2009/0139766 | A1 * | 6/2009 | Samuel et al. | 175/2 |
| 2009/0277636 | A1 * | 11/2009 | Kubala et al. | 166/293 |

FOREIGN PATENT DOCUMENTS

WO 9428085 A1 12/1994

OTHER PUBLICATIONS

Chang, F. F. et al., SPE94596. "Recommended Practice for Overbalanced Perforating in Long Horizontal Wells.", May 2005.

* cited by examiner

*Primary Examiner* — David Bagnell
*Assistant Examiner* — Blake Michener
(74) *Attorney, Agent, or Firm* — Chadwick A. Sullivan; Rodney Warfford

(57) ABSTRACT

A system for dynamic underbalanced perforation of a hydrocarbon well includes a perforation fluid located within the hydrocarbon well. A perforation gun is suspended within the perforation fluid and a completion fluid is located within the hydrocarbon uphole of the perforation fluid. An isolation fluid is located within the hydrocarbon well uphole of the perforation fluid and downhole of the completion fluid. A method of perforating a hydrocarbon well includes a perforation fluid placed in the hydrocarbon well. A perforation gun is placed within the perforation fluid. A completion fluid is placed in the hydrocarbon well. An isolation fluid is placed in the hydrocarbon well. A local dynamic underbalance condition is created in the hydrocarbon well. A flow of the completion fluid downhole is inhibited.

22 Claims, 5 Drawing Sheets

SYSTEM AND METHOD OF DYNAMIC UNDERBALANCED PERFORATING USING AN ISOLATION FLUID

FIELD

The present disclosure relates to the field of hydrocarbon well perforation. More specifically, the present disclosure relates to dynamic underbalanced well perforation using an isolation fluid.

BACKGROUND

In the recovery of hydrocarbons (e.g. oil, natural gas) it is necessary to drill a hole or well into a subsurface or subterranean hydrocarbon bearing formation. The well provides a path for the hydrocarbon to flow from the formation up to the surface. The recovery of hydrocarbons from a subterranean formation is known as "production." In such productions, a casing is installed in the drilled wellbore to provide a structurally sound conduit for the recovery of hydrocarbon. This is referred to as a cased well. Alternatively, hydrocarbons are retrieved from an uncased or "open hole" well.

It is common practice to use a fluid or mud within the wellbore in order to create a hydrostatic head. This fluid can be weighted to control the hydrostatic head in order to create varying differential pressures between the hydrocarbon formation and the wellbore. The wellbore may be placed in a static underbalanced condition wherein the wellbore pressure is less than the formation pressure. If the wellbore pressure is equal to the formation pressure, the wellbore is said to be in a balanced static condition. An overbalanced static condition is achieved when the wellbore pressure is greater than the formation pressure.

The hydrostatic head is further manipulated to control hydrocarbon production as placing the well in an underbalanced condition will draw hydrocarbon from the formation into the wellbore allowing production of the hydrocarbon to the surface.

In order to complete a well, the wellbore and one or more hydrocarbon formations adjacent the wellbore must be perforated in order to facilitate the flow of hydrocarbon from the formation into the wellbore for production to the surface. Alternatively, in an injector well, perforation of the wellbore and adjacent formations is required for fluid to be injected into the formation from the wellbore. A perforation gun string including a plurality of perforation guns may be lowered into the wellbore such that the perforation guns may be fired to perform the perforating operation. In a cased wellbore, the wellbore casing, in addition to the hydrocarbon formation, requires perforation. Similarly, in an open hole wellbore, a gun string may be used to perforate through the filtercake deposited on the wellbore and into the surrounding formation.

The explosive nature of perforating systems using a string of perforation guns may also damage the adjacent hydrocarbon formation. The firing of the perforation guns can shatter the sand grains of the formation and create rock debris as well as perforation charge debris that may fill or block the perforation tunnels. A shock damaged region of a hydrocarbon formation may have a resulting permeability that is lower than that of a virgin hydrocarbon formation matrix. The extent of the damage to the hydrocarbon formation matrix and the amount of loose debris in the perforation tunnels may be dependent upon a variety of factors including the properties of the hydrocarbon formation itself, the explosive charges themselves, pressure conditions, well fluid, and hydrocarbon properties. The shock damaged region of the hydrocarbon formation and loose debris in the perforation tunnels may impair the productivity of production wells or the injectivity of injector wells.

One known method of obtaining clear perforation tunnels is underbalanced perforating. In underbalanced perforating, the perforating operation is carried out with a static wellbore pressure lower than the formation pressure. After the creation of the perforation tunnels, hydrocarbon initially flows from the formation and through the perforation tunnels thereby clearing some of the debris from the perforation tunnel.

However, underbalanced perforating may be limited in effectiveness, safety, or cost depending upon the hydrocarbon formation and other downhole wellbore conditions. For example, when formation pressure is high and the formation matrix is weak, too large of an underbalanced pressure differential may result in collapse of the perforation tunnels and/or excessive debris production. In another example, an underbalanced well after perforation presents control and safety issues regarding the extraction of the spent perforation gun from the well while the well is in the underbalanced condition. This results in the need for additional specialized equipment and longer work times in order to complete the perforation and gun extraction.

Perforating may also be performed in an overbalanced static wellbore state that improves upon some of the negative aspects of underbalanced perforating, as noted above. However, the benefits of overbalanced perforating are typically overshadowed by a significant loss in productivity due to increased damage to the hydrocarbon formation and perforation tunnels. This negative impact on productivity has typically made underbalanced perforating a preferred choice for well completion.

The recent introduction of dynamic underbalanced perforating limits the negatives associated with both overbalanced and underbalanced perforating techniques. In dynamic underbalanced perforating, the overall wellbore is maintained in an overbalanced condition while a localized underbalanced condition is created at the perforation site that limits the perforating damage, resulting in the productivity benefits of underbalanced perforating, while maintaining the safety and efficiency benefits of an overbalanced wellbore.

In addition to perforating the target hydrocarbon formation, the wellbore itself must typically be conditioned to receive the hydrocarbons from the surrounding formation. In a cased wellbore, this means perforating the wellbore casing as well, which is typically achieved at the same time and in the same manner as the perforation of the surrounding formation. In an open wellbore, the filtercake must be removed from the sides of the open wellbore prior to production. During the drilling of an open wellbore, drilling fluid can be lost by leakage into the formation. To prevent this, a small amount of drilling fluid is often intentionally leaked off to form a hard coating, the filtercake, on the sides of the open wellbore. This filtercake must be removed in order for the well to produce.

SUMMARY

A system for dynamic underbalanced perforation of a hydrocarbon well includes a perforation fluid located within the hydrocarbon well at a target zone adjacent to a hydrocarbon formation. A perforation gun is suspended within the perforation fluid and adjacent to the hydrocarbon formation. A completion fluid is located within the hydrocarbon well uphole of the perforation fluid. The completion fluid places the perforation fluid in an overbalanced state. An isolation fluid is located within the hydrocarbon well uphole of the perforation fluid and downhole of the completion fluid. The isolation fluid has a greater viscosity than the completion fluid.

A method of perforating a hydrocarbon well includes placing a perforation fluid in the hydrocarbon well at a target zone adjacent to a hydrocarbon formation. A perforation gun is placed within the perforation fluid in the hydrocarbon well. A completion fluid is placed within the hydrocarbon well uphole of the perforation fluid. The weight of the completion fluid places the perforation fluid in an overbalanced condition relative to the pressure of the hydrocarbon formation. An isolation fluid is placed in the hydrocarbon well uphole of the perforation fluid and downhole of the completion fluid. A local dynamic underbalanced condition is created within the hydrocarbon well at the target zone by activating the perforation gun. A flow of the completion fluid downhole into the target zone is inhibited by the isolation fluid.

BRIEF DESCRIPTION OF THE DRAWINGS

The drawings illustrate the best mode presently contemplated of carrying out the invention. In the drawings.

DETAILED DESCRIPTION

As used herein, the terms "up" and "down"; "upper" and "lower"; "within" and "above"; "uphole" and "downhole"; and other like terms indicating relative positions to a given point or element are utilized to more clearly describe some elements of the embodiments disclosed herein. Commonly, these terms relate to a reference point as the surface from which drilling operations are initiated as being the top point and the total depth of the well being the lowest point.

As used herein, the term "perforating fluid" indicates the fluid in which the perforating charges cross before entering the formation. The term "completion fluid" indicates the fluid used by the operator in the wellbore to control the well during a perforating operation. The "perforating fluid" and the "completion fluid" may be the same fluid, or may be fluids of differing composition.

As used herein, the terms "tube", "tubular", and "tubing" refer to a conduit or any kind of a round hollow apparatus in general, and in the area of oil filled applications to casing, drill pipe, production piping, surface piping, metal tube, jointed pipe, coil tubing, and the like.

Dynamic underbalanced perforating may be performed in a variety of ways. In a "shoot and pull" operation, a dynamic underbalanced perforating assembly is deployed in an overbalanced well. The assembly generates a transient underbalance at the same time as the perforating operation is performed. The overbalanced state of the well nearly instantaneously overcomes the transient underbalance, returning the entire well to an overbalanced state. The gun string may then be safely removed from the overbalanced well.

Alternatively, in a closed chamber performing operation, an isolating mechanical barrier, such as an isolating packer, is set in the wellbore above the perforating system. When the guns of the perforating system are actuated, the transient dynamic underbalance is created below the isolating packer, but the isolating packer holds the overbalanced completion fluid from acting downward on the newly perforated formation. The formation fluid moves into the wellbore until the pressure of the hydrocarbon formation equals the pressure in the wellbore below the isolating packer. However, this can sometimes create a significant pressure differential across the isolating packer. When the isolating packer is released in order to withdraw the perforating system, the overbalanced completion fluid slams down onto the formation fluid causing a "water hammer" that can damage equipment, the wellbore, or the newly perforated formation.

Figure 1:
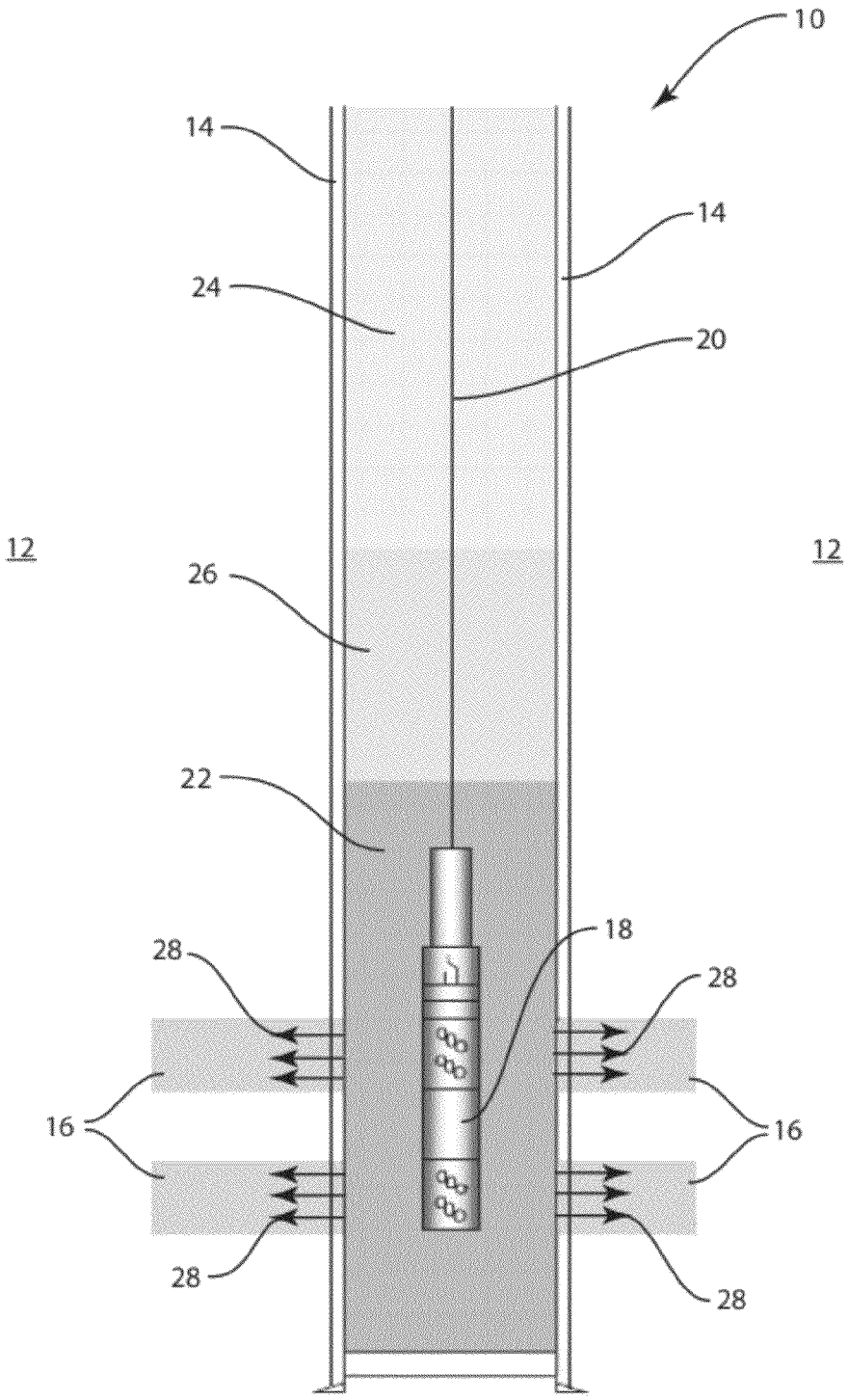
FIG. 1 is a cross sectional view of a cased wellbore and depicts an embodiment of the disclosed system.

FIG. 1 illustrates an example of a newly presented system for dynamic underbalanced perforation of a hydrocarbon well. A wellbore 10 extends from the surface (not depicted) into a hydrocarbon formation 12. As depicted in FIG. 1, the wellbore 10 is a cased wellbore, and therefore, a casing 14 separates the wellbore 10 from the hydrocarbon formation 12.

In order to begin well production, the casing 14 at the target zone 16 of the hydrocarbon formation 12 must be perforated to facilitate fluid communication between the hydrocarbon formation 12 and the wellbore 10. A perforation gun 18 is lowered into the wellbore 10 on a wire or tubing 20. The perforation gun 18 is lowered into the wellbore 10 in order to align the perforation gun 18 with the target zone 16 to be perforated. Wellbore 10 is filled with a variety of fluids as will be disclosed in further detail herein. The wellbore 10 includes a perforation fluid 22 that surrounds the perforation gun 18 and is aligned with the target zone 16 for perforation. A majority of the wellbore 10 is filled with completion fluid 24. The completion fluid 24 is used to maintain a desired pressure within the wellbore 10. Finally, as is disclosed in greater detail herein, an isolation fluid 26 is disposed between the completion fluid 24 and the perforation fluid 22.

The combined weight of the perforation fluid 22, completion fluid 24, and isolation fluid 26 exerts pressure in the wellbore 10 that is equal to or higher than the pressure of the hydrocarbon formation 12. This results in a balanced or overbalanced condition within the wellbore 10. The perforation gun 18 generates a localized transient dynamic underbalance condition when the perforation gun 18 is actuated. Charges from the perforation gun blast through the casing 14 and form perforation tunnels 28 into the target zone 16.

During the dynamic underbalance, the pressure of the hydrocarbon formation 18 exceeds the localized pressure of the wellbore 10 at the target zone 16 near the perforation gun 18. Hydrocarbon fluid, therefore, moves from the hydrocarbon formation 12 through the perforated casing 14 and newly created perforation tunnels 28 in the target zone 16 of the hydrocarbon formation 12 and into the wellbore 10. During the transient dynamic underbalanced condition, the hydrostatic weight of the completion fluid 24 and the isolation fluid 26 acts downwardly onto the hydrocarbon flowing out of the hydrocarbon formation 12 and into the wellbore 10, thus "killing" the well production. However, as will be detailed further herein, the resistive properties of the isolation fluid 26 inhibits and slows the downward movement of the completion fluid 24 and the isolation fluid 26 which allows the hydrocarbon from the hydrocarbon formation 12 to exit the formation 12 into the wellbore 10 for a longer time period, resulting in greater clearing of the perforation tunnels 28 in the casing 14 and target zone 16 created by the perforation gun 18. This hydrocarbon flow is permitted to continue until the downward movement of the completion fluid 24 and isolation fluid 26 acts fully on the hydrocarbon formation 12, thus restoring the wellbore 10 to a balanced or overbalanced condition and ending hydrocarbon production from the formation 12.

It is to be noted that the completion fluid 24 and the perforation fluid 22 may be the same or similar fluids, or may be different fluids and each may be selected from fluid types including, but not limited to, an acid, a solvent, a de-emulsifier, or other completion fluid or perforation fluid known in the art.

During the completion operation, prior to perforating, a well operator may identify a target delay for the well to be restored to the balanced or overbalanced condition once the transient dynamic underbalanced condition has been created. The target delay can be predicted in one of several ways, including using empirical data from pervious well operations or simulations performed with modeling software.

Figure 2:
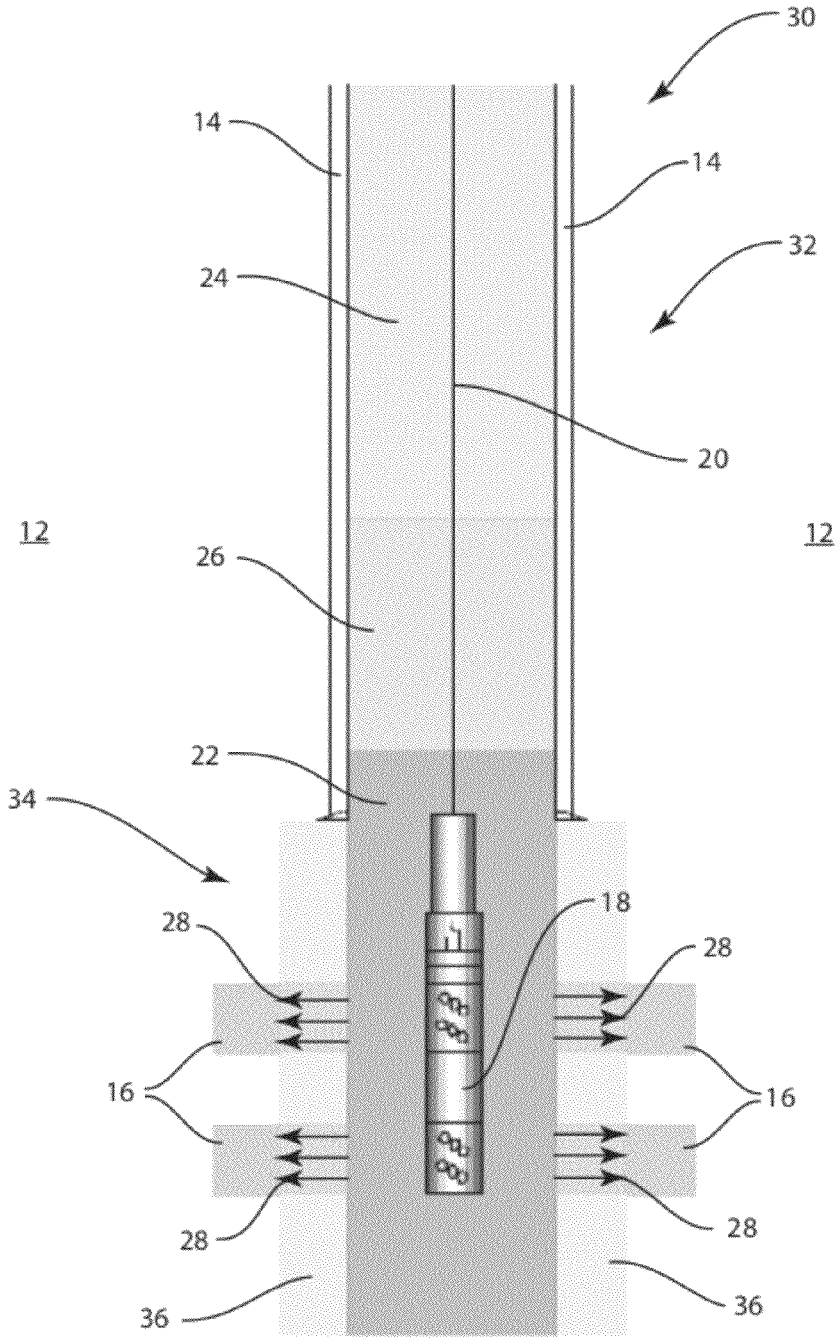
FIG. 2 is a cross sectional view of an open wellbore and depicts an embodiment of the disclosed system.

FIG. 2 depicts the same embodiment of the perforating system and therefore uses like numerals to identify like structures. In FIG. 2, the perforating system is used in a wellbore 30 that includes both a cased segment 32, wherein the wellbore 30 is surrounded by a casing 14 and an uncased segment 34 where there is no casing between the wellbore 30 and the hydrocarbon formation 12.

As noted above, during the drilling of the uncased segment 34, the drilling fluid may be controlled to produce a layer of filtercake 36 between the hydrocarbon formation 12 and the wellbore 30.

Similar to that depicted in FIG. 1, the wellbore 30 is filled with perforation fluid 22, completion fluid 24, and isolation fluid 26. The perforation fluid is placed in the wellbore 30 adjacent to the hydrocarbon formation 12 to be perforated, and surrounding the perforation gun 18. The completion fluid 24 is within the wellbore 30 above the perforation fluid 22. The isolation fluid 26 is placed between the perforation fluid 22 and the completion fluid 24. It is to be noted that the order in which the fluids (22, 24, 26) are placed within the wellbores 30 may be in any order that is deemed suitable based upon the conditions of the wellbore 30. In one embodiment, the completion fluid 24 is maintained in the wellbore 30 and the perforation fluid 22 and isolation fluid 26 are placed afterwards. In an alternative embodiment, the fluids are placed in the wellbore 30 in the order in which they appear, with the perforation fluid 22, the isolation fluid 26 next, and finally the completion fluid 24. In still another embodiment, the completion fluid 24 and the perforation fluid 22 are placed in the wellbore 30 and the isolation fluid 26 is then placed between the perforation fluid 22 and the completion fluid 24.

It is similarly to be noted that the perforation gun 18 may be lowered into the wellbore 30 with the wire or tubing 20 at any time during the placement of the fluids within the wellbore 30. Therefore, the perforation gun 18 may be lowered into the wellbore 30 prior to the placement of the perforation fluid 22, isolation fluid 26, and completion fluid 24, or may be located within the wellbore 30 after the placement of the perforation fluid 22, isolation fluid 26, and completion fluid 24.

The combined weight of the perforation fluid 22, completion fluid 24, and isolation fluid 26 exerts pressure in the wellbore 30 that is equal to or higher than the pressure of the hydrocarbon formation 12. This results in the wellbore 30 being in a balanced or overbalanced condition.

A transient dynamic underbalance condition is generated when the perforation gun 18 is actuated. The actuation of the perforation gun 18 not only creates the transient dynamic underbalance condition, but also produces perforating jets that perforate the filtercake 36 and the target zone 16 of the hydrocarbon formation 12. During the transient dynamic underbalance, the pressure of the hydrocarbon formation 12 exceeds the localized wellbore pressure near the perforation gun 18 and hydrocarbon moves from the hydrocarbon formation 12 through the perforation tunnels 28 and into the wellbore 30. During the transient dynamic underbalance, the resulting localized underbalance near the perforation gun 18 causes the hydrostatic weight of the completion fluid 24 and the isolation fluid 26 to act downward onto the hydrocarbons in the wellbore and the hydrocarbon formation 12 to "kill" the well production.

The resistive properties of the isolation fluid, as will be discussed in greater detail herein, inhibit and slow the downward movement of the completion fluid 24 and the isolation fluid 26. This prolongs the flow of hydrocarbon from the hydrocarbon formation 12 into the wellbore 30 through the perforation tunnels 28. The continued downward movement of the completion fluid 24 and isolation fluid 26 continues until the weight of the completion fluid 24, isolation fluid 26, and perforation fluid 22 acts fully on the hydrocarbon formation 12 and restores the wellbore 30 to a balanced or overbalanced condition thus effectively killing well production.

Figure 3:
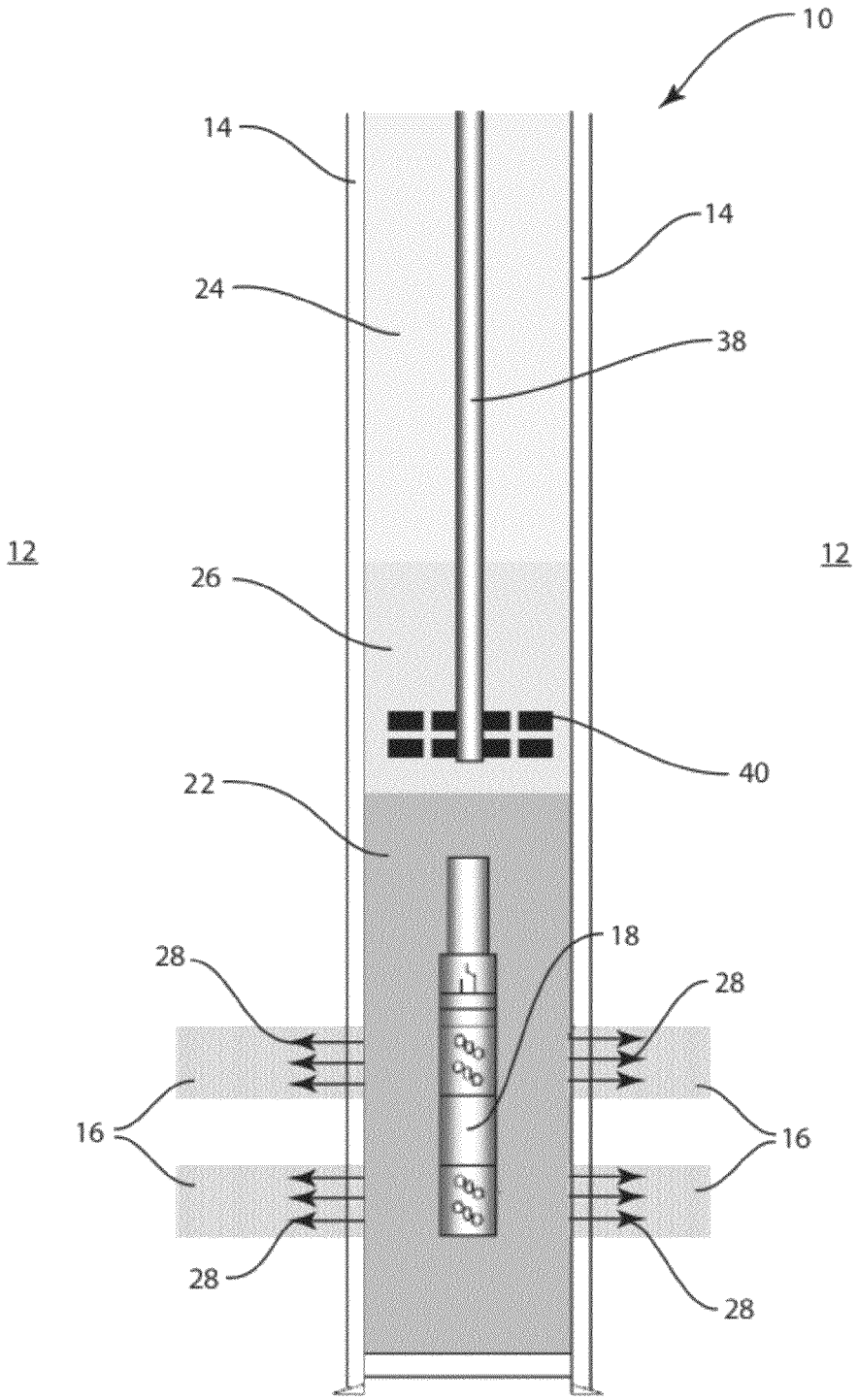
FIG. 3 is a cross sectional view of a cased wellbore and depicts an embodiment of the disclosed system using a surge restrictor.

FIG. 3 depicts a further embodiment of the disclosed system, using an isolation fluid 26 above the perforation fluid 22 located within a wellbore 10. The perforation fluid 22 is placed adjacent to the target zone 16 for perforation of a hydrocarbon formation 12. The isolation fluid 26 allows control of the restoration time as the weight of the completion fluid 24 and the isolation fluid 26 moves these fluids downhole in response to the creation of a localized transient dynamic underbalanced condition in the area of the perforation gun 18 and the target zone 16 for perforation. It is to be noted that the wellbore 10 depicted in FIG. 3 is a fully cased wellbore; however, the wellbore may alternatively include an open wellbore section. FIG. 3 uses like numerals to identify similar structures that appear in FIGS. 1 and 2.

The embodiment of FIG. 3 further includes a mechanical barrier, such as a surge restrictor 40 that is placed within the isolation fluid 26. The mechanical barrier may be placed in the wellbore 10 prior to the performance of the perforation operation in order to restrict and further delay movement of the completion fluid 24 and the isolation fluid 26 downward into the localized transient dynamic underbalance and onto the hydrocarbon formation 12 to "kill" the well. The mechanical barrier, which may be a surge restrictor 40, as depicted, helps to further restrict this downward flow, providing additional time for hydrocarbon to flow from the hydrocarbon formation 12 into the wellbore 10 through the perforation tunnels 28.

Albeit impeded, eventually the downward movement of the completion fluid 24 and the isolation fluid 26 continues until the combined weight of the perforating fluid 22, isolation fluid 26, and the completion fluid 24 acts fully on the hydrocarbon formation 12, restoring it to a balanced or overbalanced condition and effectively killing well production.

The restrictor 40 can be deployed and retrieved within the wellbore 10 using a drill pipe 38 as depicted, or alternatively, a wire or tubing, as depicted in FIGS. 1 and 2, which may be braided wire, slickline, wireline, coiled tubing, or any other similar conveyance known to those skilled in the art depending on the specific well conditions. The restrictor 40 is set in place after the perforation gun 18 has been placed in alignment with the target zone 16 of the hydrocarbon formation 12.

The viscous, resistive, and shear properties of the isolation fluid 26 as well as the restriction size of the surge restrictor 40 can be selected in order to predict the flow rate of the isolation fluid 26 through the restrictor 40. In a simple embodiment, the restrictor 40 may be a plate with a series of holes through which the fluids must pass, the restrictor 40 forces this flow at a slower rate than if no mechanical barrier were in place. From the known conditions within the wellbore 10, the properties of the isolation fluid 26, and the properties of the restrictor 40, an operator is able to calculate and control the duration of the delay before the hydrostatic weight of the completion fluid 24, isolation fluid 26, and perforation fluid 22 restores the well to a balanced or overbalanced state after the transient dynamic underbalance condition, killing well production. This calculated target delay can be predicted based upon empirical data from previous well operations, or on simulations performed with modeling software.

Further control of this delay time may be achieved by the specific placement of the restrictor 40 within the isolation fluid 26 disposed in the wellbore 10. This gives additional control to the operator by retaining the same total volume of isolation fluid 26, but controlling the amount of the isolation fluid that must pass through the restrictor 40.

In some perforating operations it is a safety requirement to have a mechanical barrier present and deployed prior to actuation of the perforation gun 18. In other instances, it is required to have the mechanical barrier in position within the wellbore 10, and not deployed, but ready to be set in place after the perforating operation.

Figure 4:
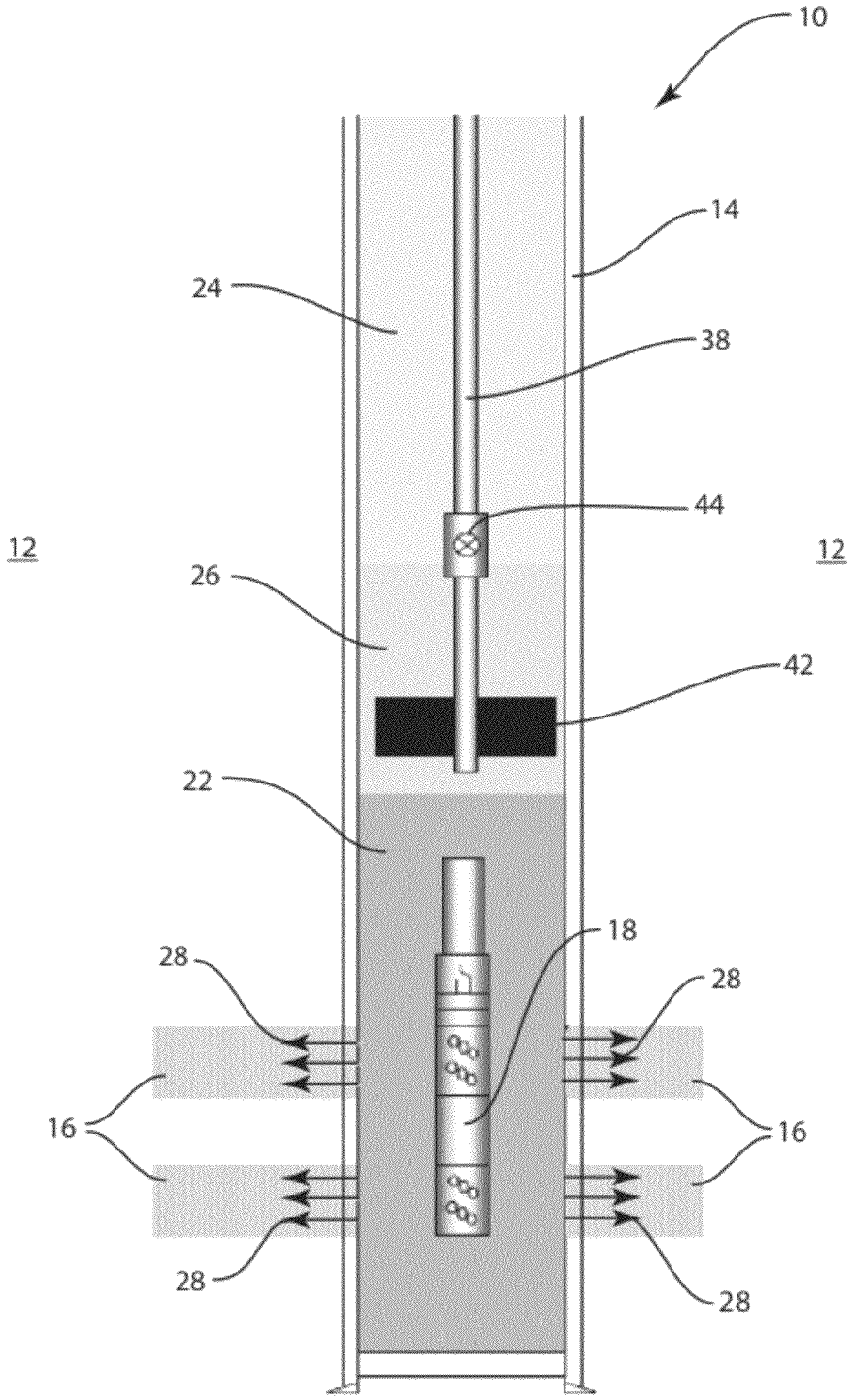
FIG. 4 is a cross sectional view of a cased wellbore and depicts an embodiment of the disclosed system utilizing an isolating packer.

FIG. 4 illustrates a still further embodiment that uses an isolating packer 42 as the mechanical barrier placed within the wellbore 10. It is to be noted that in FIG. 4, a cased wellbore is depicted and like reference numerals refer to like structures that have been disclosed and described in further detail above.

In the embodiment of FIG. 4, the deployed isolating packer 42 completely seals across the wellbore 10, thus preventing all movement of the isolation fluid 26 and the completion fluid 24 above the isolating packer 42 from migrating down the wellbore 10 overcoming the localized transient dynamic underbalance created by the perforation gun 18 and killing well production of hydrocarbons.

Therefore, the hydrocarbons of the hydrocarbon formation 12 are free to flow through the perforation tunnels 28 from the hydrocarbon formation 12 into the wellbore 10, until the pressure below the isolating packer 42 balances the pressure of the hydrocarbon formation 12.

As noted above, when this technique is implemented in an overbalanced wellbore 10, a pressure differential is created across the isolating packer 42. The balanced condition between the wellbore 10 and the hydrocarbon formation 12 below the isolating packer is at a lower pressure than the overbalanced condition in the wellbore 10 above the isolating packer 42. The release of the isolating packer 42 can create the dangerous and destructive "water hammer" effect as the hydrostatic pressure of the completion fluid 24 above the isolating packer 42 inflicts its overpressure against the balanced pressure of the wellbore below the isolating packer 42.

In the presently disclosed embodiment, the isolating packer 42 is disposed within or below an isolation fluid 26. The isolation fluid 26 thereby serves as an impedance or barrier to the downward flow of the completion fluid 24 against the perforation fluid 22 and hydrocarbons of the hydrocarbon formation 12. The impedance effect of the isolation fluid 26 reduces the "water hammer" effect, thereby reducing the negative result of this effect.

In some embodiments, the mechanical barrier such as the isolating packer 42 is deployed and retrieved using a hollow drill pipe 38. To ensure complete mechanical isolation of the hollow tubing or drill pipe 38, an isolating valve 44 is deployed at a position above the isolating packer 42. While the embodiment of FIG. 4 depicts a drill pipe 38, it is also understood that the isolating packer 42 may be deployed and retrieved using hollow tubing, braided wire, slickline, wireline, or coiled tubing, as understood by one of ordinary skill in the art, depending upon the specific well conditions.

In the following, additional details will be disclosed regarding the isolation fluid as used in the systems disclosed above.

The isolation fluid is a fluid with sufficient resistive properties to remain where it is placed within the wellbore or tubing, yet to allow for a degree of differential pressure or gravity-induced flow when the hydrostatic pressure above the isolation fluid is higher than the pressure below the isolation fluid. The isolation fluid further includes sufficient viscous and shear properties to be placed in the required position within the wellbore by pumping the fluid into the desired location. For example, the isolation fluid could be pumped from the surface through the drill pipe, or tubing, or deployed in a container and released at the desired position within the wellbore.

The isolation fluid may be formed by the combination of one or more fluids through one or more stages of deployment or placement. For example, a first fluid may be injected through the drill pipe and placed in position in the wellbore, and then the first fluid is followed with a second triggering fluid which alters the viscous and shear properties of the resulting isolation fluid to that which is desired. In this example, the first fluid may be primarily thixotrophic in nature. In further embodiments, the triggering fluid may already be existing in the wellbore at the desired location, or the triggering fluid is introduced into the wellbore secondly at a later time during the perforation operation.

The isolation fluid further includes characteristics such as to remain stable for the duration of the perforating operation as well as be stable when the isolation fluid comes in contact with other fluids in the wellbore. For example, an isolation fluid must be stable for a multiple day perforating operation, and be stable to remain at elevated temperatures found deep within wellbores, which may be meet or exceed 122° C. Additionally, the isolation fluid must remain stable when the completion fluid is a low density monovalent brine and the perforating fluid is a suitable de-emulsifier.

The time delay between the creation of the transient dynamic underbalance and the restoration of the wellbore to a balanced or overbalanced condition using an isolation fluid can be controlled by adjusting the volume of the isolation fluid, any of the resistive, viscous and shear properties of the isolation fluid, or the position of the isolation fluid within the wellbore. The appropriate configuration of volume, properties, and placement within the wellbore can be determined based upon empirical data from previous operations or from software modeling and simulations. Determining the appropriate configuration to be used within the wellbore can be determined by software that is executable in a system such as a computer system. This software can be executable on one or more processors within the computer system. Various other parameters used in calculating other parameters for the perforating operation, such as other wellbore fluids, hydrocarbon formation composition, perforation gun system parameters, may also be considered and included in the determination of the desired volume, properties, and position of the isolation fluid.

While the suggested composition of the isolation fluid has been described herein as comprising certain materials, it should be understood that the composition could optionally comprise one or more chemically different materials, as well as being comprising of some components other than the ones already disclosed, such as would be obvious of ordinary skill in the art.

In embodiments, the isolation fluid may be comprised partially or solely of compressible or incompressible fluids. These may partially or fully include compositions of foams, oil based components, nitrogen, carbon dioxide, or air.

In still further embodiments, the isolation fluid is created by blending two or more gel components, cross linking agents, or other additives, provided that the compounds chosen for the mixed isolation fluid is stable and compatible with the isolation fluid as disclosed herein. Such additives may include, but are not limited to, insoluble solids, fibers, flakes, platelets, viscosifiers, surfactants, mineral acids, organic acids, chelating agents, alcohols, amines, mutual solvents, co-surfactants, enzymes, defoamers, wettability modifiers, permeability modifiers, nanotubes, or stabilizers.

When the perforating operation is completed, it can be desirable for the isolation fluid to disappear, or to have its viscosity reduced permanently to allow the well to be produced. The isolation fluid can be reduced or broken down through dilution with water, solvents, condensate, or other techniques. Alternatively, the isolation fluid can be reduced or broken down by adding a separate breaker compound or breaker precursor or by introducing electrical and/or heat energy.

Alternatively, the isolation fluid can be blended such that it does not have long term thermal stability at the temperatures found within the wellbore within which it is deployed. For example, an isolation fluid prepared using zwitterionic surfactants can have the time at which it degradation occurs within the wellbore at a specified temperature controlled by the choice of the surfactant itself, the surfactant concentration, and brine.

The barrier fluid may alternatively be blended using certain viscoelastic surfactants and high density brines (defined herein as brines having a density of 1.2 kg/L or 12.5 ppg). Alternatively, high density brines may be defined as having a density of about 1.5 kg/L. The isolation fluid blend must be stable in the operating environment of the wellbore with particular attention to the temperature within the wellbore at the location of the isolation fluid deployment. For example, aqueous gels made from cationic surfactants are compatible with heavy calcium brines, but only up to a temperature of about 71° C. (160° F.). In another example, several zwitterionic surfactants have been found to be particularly useful in forming aqueous gels of exceptional thermal stability in excess of 177° C. This stability can be found even in high salinity and/or heavy brines. This stability in heavy brines at unexpectedly high temperatures together with the ability of these aqueous gels to be deployed without the addition of further fluid loss materials such as starch, sized salts, carbonate ships, mica, or other particulates are important features of embodiments of the isolation fluid that can be used within the present system and method.

High density brines as disclosed herein can be made from salts or divalent metals such as calcium and zinc, as well as from potassium, ammonium, sodium, and cesium. Organic cations such as ammonium and tetramethylammonium may also be used. Typical inorganic anions for high density brines include chloride and bromide, although organic anions such as formate and acetate may also be used. Some of the brines made from some combinations of these anions and cations may not impart sufficient density and may have to be used in combinations with other anions and cations that give higher density brines. Such mixtures can also be used in the isolation fluid blends once high viscosity gels sufficiently stable across the necessary temperature range are achieved.

It should be noted that when a fluid is described as being made by adding a salt, this may mean by combining anhydrous or hydrated salts with a fluid or by combining a brine (such as a concentrated or saturated brine) with a fluid. The combining of one or more salts with one or more fluids may typically be done in any order.

Alternatively, polymer gels can be blended and used as the isolation fluid. These are typically formed by dissolving or hydrating a suitable polymer in water. Often, these aqueous fluids are further thickened or viscosified by crosslinking the polymers, for example, with organic or metal crosslinkers. Typical crosslinkers can be boron, titanium, zirconium carbonate, or bicarbonates, or any other crosslinkers as may be recognized by one of ordinary skill in the art.

Suitable polymers can be water soluble or hydratable and can as an example include polysaccharides composed of mannose and galactose sugars, such as locust bean gum, karaya gum, guar gums, or guar derivatives such as hydroxypropyl guar (HPG), hydroxyethyl guar (HEG), carboxymethyl guar (CMG), carboxymethylhydroxyethyl guar (CMHEG), carboxymethylhydroxypropyl guar (CMHPG), and hydrophobically modified guar. Cellulose derivatives such as hydroxyethylcellulose (HEC), hydroxypropylcellulose (HPC), and carboxymethylhydroxyethylcellulose (CMHEC) can also be used. Xanthan, diutan, scleroglucan, polyvinylalcohol, polyacrylamide and polyacrylate polymers and copolymers are also suitable.

In a still further embodiment, the isolation fluid can be blended into a "loose invert emulsion". Such a "loose invert emulsion" may be a rheotropic plugging fluid. The continuous phase of the "loose invert emulsion" provides an encapsulation medium for a crosslinker and the internal phase consists of a high concentration of a polymer. When the polymer blend is exposed to a significant pressure drop, an inversion of the emulsion occurs and the crosslinker is released into the aqueous phase resulting in the formation of a viscous liquid. Such a fluid can be stored several weeks without reacting and may be pumped for several hours. These features allow this embodiment of the isolation fluid to be pumped into position through a tubular conduit, such as tubing. As gellation of this embodiment of the isolation fluid is fast and triggered only by subjecting the fluid to high shear forces, the fluid can be spotted exactly in position at the end of the tubing using a drill bit or nozzle restriction. This type of fluid lacks stability over a prolonged time and becomes less rigid above 90° C. due to the breaking down of the crosslinked bonds. It, therefore, can be left to decompose within the wellbore, allowing the well to be completed and placed in production after the perforating operation is complete.

Figure 5:
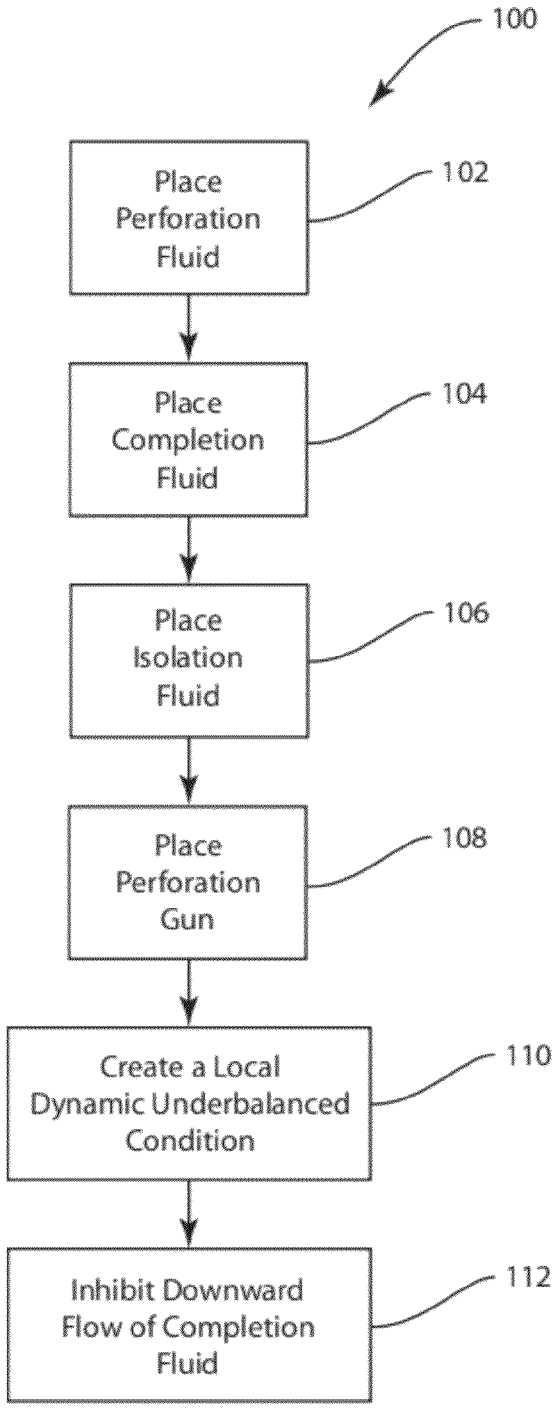
FIG. 5 is a flow chart depicting an embodiment of the method disclosed herein.

FIG. 5 is a flow chart depicting the steps of an embodiment of a method of perforating a hydrocarbon well 100.

The method 100 includes placing a perforation fluid within the wellbore 102, placing a completion fluid within the wellbore 104, placing an isolation fluid within the wellbore 106, and placing a perforation gun within the wellbore 108. While these features of the method 100 have been listed in this particular order, embodiments of the method may execute these features in varying order based upon the procedures for the specific perforating operation, or wellbore conditions. Such placement elements may be performed in any order so long as the end result is a wellbore with a perforation gun disposed within a perforation fluid with a completion fluid above the perforation fluid and an isolation fluid disposed between the completion fluid and the perforation fluid.

Additional elements of the method, but not depicted in FIG. 5, may include placing a mechanical barrier within the isolation fluid. Such a mechanical barrier may be a surge restrictor or an isolating packer. The placement of the mechanical barrier within the isolation fluid may place the mechanical barrier within the isolation fluid such that isolation fluid is located both above and below the mechanical barrier within the wellbore. Alternatively, the mechanical barrier may be placed at the interface between the isolation fluid and the perforation fluid, such that all of the isolation fluid is above the mechanical barrier within the wellbore.

Next, at 110, a local dynamic underbalanced condition is created. This local dynamic underbalanced condition may be created by the actuation of the perforation gun. The perforation gun both creates the local dynamic underbalanced condition as well as creates perforation jets that extend from the perforation gun. In an embodiment, the perforation gun creates the local dynamic underbalanced condition within the wellbore below the isolation fluid. The actuation of the perforation gun further creates perforation jets that may perforate the wellbore as well as the adjacent hydrocarbon formation. The perforation of the wellbore and the adjacent hydrocarbon formation combined with the created local dynamic underbalanced condition produces hydrocarbon from the hydrocarbon formation into the wellbore.

The creation of the local dynamic underbalanced condition further draws the isolation fluid and the completion fluid down towards the perforations in the wellbore and the hydrocarbon formation due to the hydrostatic pressure and weight of the completion fluid and the isolation fluid. However, at 112, the downward flow of the completion fluid is inhibited. In an embodiment, a viscous property of the isolation fluid inhibits the downward flow of the completion fluid as the hydrostatic pressure of the completion fluid must overcome the viscous properties of the isolation fluid in order to flow down well. In a further embodiment, the downward flow of the completion fluid is further inhibited by a mechanical barrier placed within the isolation fluid. Such a mechanical barrier may be a surge restrictor or an isolating packer.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Various alternatives and embodiments are contemplated as being with in the scope of the following claims, particularly pointing out and distinctly claiming the subject matter regarded as the invention.

What is claimed is:

1. A system for dynamic underbalanced perforation of a hydrocarbon well, the system comprising:

a perforation liquid located within the hydrocarbon well at a target zone adjacent to a hydrocarbon formation;

a perforation gun suspended within the perforation liquid and adjacent to the hydrocarbon formation;

a completion liquid located within the hydrocarbon well uphole of the perforation liquid, a weight of the completion liquid places the perforation liquid in an overbalanced state; and an isolation fluid located within the hydrocarbon well uphole of the perforation liquid and downhole of the completion liquid, the isolation fluid having a greater viscosity than the completion liquid.

2. The system of claim 1 wherein the perforation gun creates a dynamic underbalanced condition local to the target zone of the well, the isolation fluid impedes the movement of the completion liquid downhole, lengthening a duration of the localized underbalanced condition.

3. The system of claim 2 further comprising a mechanical barrier disposed within the isolation fluid, the mechanical barrier further impeding the movement of the completion liquid downhole.

4. The system of claim 3 wherein the mechanical barrier is an isolating packer.

5. The system of claim 3 wherein the mechanical barrier is a surge restrictor.

6. The system of claim 2 wherein the isolation fluid comprises an aqueous gel.

7. The system of claim 2 wherein the isolation fluid comprises a viscosifier.

8. The system of claim 2, wherein the isolation fluid comprises a high density brine.

9. The system of claim 2, wherein the isolation fluid comprises a viscoelastic surfactant.

10. The system of claim 2, wherein the isolation fluid comprises a polymer gel.

11. The system of claim 2, wherein the isolation fluid comprises a loose invert emulsion.

12. The system of claim 2, wherein the isolation fluid decomposes with prolonged exposure to a condition within the wellbore.

13. A method of perforating a hydrocarbon well, the method comprising:

placing fluids and a perforation gun in a hydrocarbon well comprising:

placing a perforation liquid, completion liquid and isolation fluid in the hydrocarbon well so that the perforation liquid is positioned at a target zone adjacent to a hydrocarbon formation, the completion liquid is positioned in the hydrocarbon well uphole of the perforation liquid, and the isolation fluid is positioned in the hydrocarbon well uphole of the perforation liquid and downhole of the completion liquid, so that, with the perforation liquid, completion liquid and isolation fluid so positioned, a wellbore pressure in the wellbore in the target zone adjacent the hydrocarbon formation is at least equal to the formation pressure in the hydrocarbon formation adjacent he target zone; and placing the perforation gun in the hydrocarbon well so that, with the perforation gun, perforation liquid, completion liquid and isolation fluid in the well, the perforation gun is positioned so that, upon activation thereof, the perforation gun perforates the formation adjacent the target zone, creating a local dynamic underbalanced condition within the hydrocarbon well at the target zone by activating the perforation gun; and inhibiting a flow of the completion liquid downhole into the target zone with the isolation fluid, wherein the isolation fluid has a viscosity greater than a viscosity of the perforation liquid and a viscosity of the completion liquid.

14. The method of claim 13, further comprising:

placing a mechanical barrier in the hydrocarbon well within the isolation fluid;

wherein the mechanical barrier further inhibits the flow of the completion liquid downhole.

15. The method of claim 14 wherein the mechanical barrier is an isolation packer.

16. The method of claim 14 wherein the mechanical barrier is a surge restrictor.

17. The method of claim 13 wherein placing the isolation fluid in the hydrocarbon well, includes pumping the isolation fluid into the hydrocarbon well.

18. The method of claim 17 wherein the isolation fluid comprises a first fluid at a first viscosity and a second fluid at a second viscosity, the first fluid being reactive with the second fluid to form the isolation fluid, wherein the isolation fluid has a higher viscosity than either of the first fluid or the second fluid.

19. The method of claim 13 wherein the perforating liquid is placed at an overbalanced condition, prior to the creation of the local dynamic underbalanced condition.

20. A system for perforating a hydrocarbon well comprising a wellbore extending into a hydrocarbon formation, the system comprising:

a perforation liquid in the wellbore adjacent to a target zone for perforation of the hydrocarbon formation;

a completion liquid in the wellbore uphole of the perforation liquid;

an isolation fluid in the wellbore between the perforation liquid and the completion liquid, the isolation fluid having a greater viscosity that the perforation liquid and the completion liquid; and a perforation gun in the wellbore within the perforation liquid and aligned with the target zone; the actuation of the perforation gun creates a localized dynamic underbalanced condition;

wherein the localized dynamic underbalanced condition causes a flow of the completion liquid and the isolation fluid downhole, the flow being impeded by the viscosity of the isolation fluid.

21. The system of claim 20 wherein a hydrostatic pressure in the wellbore from the completion liquid, the isolation fluid, and the perforation liquid is greater than a hydrostatic pressure of the hydrocarbon formation.

22. The system of claim 21 wherein actuation of the perforation gun further creates perforation jets that create perforation tunnels in the target zone of the hydrocarbon formation and the local dynamic underbalanced condition draws hydrocarbons out of the hydrocarbon formation and into the wellbore.

* * * * *